US007417602B2

(12) United States Patent
Mizuta

(10) Patent No.: US 7,417,602 B2
(45) Date of Patent: Aug. 26, 2008

(54) PLASMA DISPLAY PANEL AND DRIVING METHOD THEREOF

(75) Inventor: Takahisa Mizuta, Suwon (KR)

(73) Assignee: Samsung SDI Co., Ltd., Suwon-si (KR)

( * ) Notice: Subject to any disclaimer, the term of this patent is extended or adjusted under 35 U.S.C. 154(b) by 661 days.

(21) Appl. No.: 10/796,225

(22) Filed: Mar. 9, 2004

(65) Prior Publication Data

US 2004/0217922 A1 Nov. 4, 2004

(30) Foreign Application Priority Data

Apr. 29, 2003 (KR) ..... 10-2003-0027285

(51) Int. Cl.
*G09G 3/28* (2006.01)

(52) U.S. Cl. ..... 345/60; 345/61; 345/62; 345/67; 345/69

(58) Field of Classification Search ..... 345/60–69, 345/208; 315/169.1, 169.4, 169.2, 169.3; 313/582, 484

See application file for complete search history.

(56) References Cited

U.S. PATENT DOCUMENTS 3,840,779 A * 10/1974 Schermerhorn ..... 345/68
4,066,929 A * 1/1978 Okamoto et al. ..... 345/65
4,077,033 A * 2/1978 Strom ..... 345/69
5,854,540 A * 12/1998 Matsumoto et al. ..... 315/169.1
5,963,184 A 10/1999 Tokunaga et al.
6,034,482 A * 3/2000 Kanazawa et al. ..... 315/169.4
6,104,361 A 8/2000 Rutherford
6,144,348 A * 11/2000 Kanazawa et al. ..... 345/60
6,160,529 A * 12/2000 Asao et al. ..... 345/60
6,236,165 B1 * 5/2001 Ishizuka ..... 315/169.1
6,340,866 B1 1/2002 Yoo
6,628,251 B1 * 9/2003 Ishizuka ..... 345/60
6,630,916 B1 * 10/2003 Shinoda ..... 345/60
6,856,305 B2 * 2/2005 Nagano ..... 345/60

(Continued)

FOREIGN PATENT DOCUMENTS

EP 0 752 696 1/1997

(Continued)

OTHER PUBLICATIONS

Patent Abstracts of Japan for Publication No. 2000-206934, date of publication Jul. 28, 2000, in the name of Amano Yoshifumi.

(Continued)

*Primary Examiner*—Prabodh Dharia
(74) *Attorney, Agent, or Firm*—Christie, Parker & Hale, LLP

(57) ABSTRACT

A method for driving a plasma display panel. A discharge occurs at a selected discharge cell by scan and address pulses to form wall charges in an address period. A setup pulse is applied to a scan electrode in a sustain period. A discharge occurs between sustain and scan electrodes by a wall voltage of the sustain and scan electrodes and a voltage of the setup pulse when the setup pulse is applied. A self discharge occurs between the sustain and scan electrodes when the setup pulse falls, to form space charges. A sustain pulse is applied to the sustain and scan electrodes, and a sustain occurs by the space charges and the sustain pulse.

32 Claims, 10 Drawing Sheets

U.S. PATENT DOCUMENTS

| | | | | |
|---|---|---|---|---|
| 6,900,598 | B2 * | 5/2005 | Hibino et al. | 315/169.4 |
| 6,900,782 | B2 * | 5/2005 | Tokunaga et al. | 345/60 |
| 7,030,839 | B2 * | 4/2006 | Higashino et al. | 345/60 |
| 2001/0005202 | A1 * | 6/2001 | Tomio et al. | 345/208 |
| 2001/0017605 | A1 * | 8/2001 | Hashimoto et al. | 345/60 |
| 2002/0008679 | A1 * | 1/2002 | Rutherford | 345/60 |
| 2002/0014846 | A1 * | 2/2002 | Van Heusden et al. | 315/169.1 |
| 2002/0033677 | A1 * | 3/2002 | Okada | 315/169.1 |
| 2002/0047578 | A1 | 4/2002 | Kishi et al. | |
| 2002/0047584 | A1 * | 4/2002 | Rutherford | 315/169.4 |
| 2002/0067127 | A1 * | 6/2002 | Makino | 313/582 |
| 2002/0067136 | A1 * | 6/2002 | Okamura et al. | 315/169.3 |
| 2002/0067320 | A1 * | 6/2002 | Holtslag et al. | 345/60 |
| 2002/0101151 | A1 * | 8/2002 | Choi et al. | 313/484 |
| 2002/0171369 | A1 * | 11/2002 | Son et al. | 315/169.4 |
| 2002/0195970 | A1 | 12/2002 | Lim et al. | |
| 2003/0001799 | A1 | 1/2003 | Bae | |
| 2003/0020674 | A1 * | 1/2003 | Higashino et al. | 345/60 |
| 2003/0038757 | A1 | 2/2003 | Kojima | |
| 2003/0107532 | A1 * | 6/2003 | Choi | 345/60 |
| 2003/0122742 | A1 * | 7/2003 | Akiba | 345/63 |
| 2003/0141824 | A1 * | 7/2003 | Homma | 315/169.3 |
| 2003/0189531 | A1 * | 10/2003 | Kim | 345/60 |
| 2004/0021622 | A1 * | 2/2004 | Nagao et al. | 345/60 |
| 2004/0027317 | A1 * | 2/2004 | Seguin | 345/63 |
| 2004/0233126 | A1 * | 11/2004 | Moore | 345/60 |
| 2006/0139246 | A1 * | 6/2006 | Choi | 345/60 |

FOREIGN PATENT DOCUMENTS

| | | | |
|---|---|---|---|
| EP | 0 790 597 | A1 | 8/1997 |
| EP | 1 116 203 | B1 | 10/2003 |
| JP | 8-160910 | | 6/1996 |
| JP | 8-314405 | | 11/1996 |
| JP | 10-171399 | | 6/1998 |
| JP | 11-65524 | | 3/1999 |
| JP | 11-143422 | | 5/1999 |
| JP | 11-219150 | | 8/1999 |
| JP | 11-282415 | | 10/1999 |
| JP | 2000-206934 | | 7/2000 |
| JP | 2000-215814 | | 8/2000 |
| JP | 2001-75531 | | 3/2001 |
| JP | 2001-228820 | | 8/2001 |
| JP | 2001-228821 | | 8/2001 |
| JP | 2001-306029 | | 11/2001 |

OTHER PUBLICATIONS

Lee et al, "Some Discharge Characteristics of Surface Discharge AC PDPs by the Voltage Transfer Curve", Journal of Electrical Engineering and Information Science, vol. 4, No. 4, 1999, pp. 466-471.

European Search Report, dated Jun. 9, 2005, for Application No. 04090045.8, in the name of Samsung SDI Co., Ltd.

European Search Report, dated Sep. 14, 2005, for Application No. 04090045.8, in the name of Samsung SDI Co., Ltd.

EPO Patent Abstracts of Japan for Publication No. 10171399, Publication date Jun. 26, 1998, in the name of M. Ishigaki.

Patent Abstracts of Japan, Publication No. 08-160910; Date of Publication: Jun. 21, 1996; in the name of Takayoshi Nagai.

Patent Abstracts of Japan, Publication No. 08-314405; Date of Publication: Nov. 29, 1996; in the name of Tan Niyan Guen et al.

Patent Abstracts of Japan, Publication No. 11-065524; Date of Publication: Mar. 9, 1999; in the name of Takashi Hashimoto et al.

Patent Abstracts of Japan, Publication No. 11-143422; Date of Publication: May 28, 1999; in the name of Takashi Hashimoto et al.

Patent Abstracts of Japan, Publication No. 11-219150; Date of Publication: Aug. 10, 1999; in the name of Atsushi Yokoyama et al.

Patent Abstracts of Japan, Publication No. 11-282415; Date of Publication: Oct 15, 1999; in the name of Takashi Hashimoto et al.

Patent Abstracts of Japan, Publication No. 2000-215814; Date of Publication: Aug. 4, 2000; in the name of Yoshifumi Amano.

Patent Abstracts of Japan, Publication No. 2001-075531; Date of Publication: Mar. 23, 2001; in the name of Takashi Sasaki et al.

Patent Abstracts of Japan, Publication No. 2001-228820; Date of Publication: Aug. 24, 2001; in the name of Takayoshi Nagai.

Patent Abstracts of Japan, Publication No. 2001-228821; Date of Publication: Aug. 24, 2001; in the name of Shinji Masuda et al.

Patent Abstracts of Japan, Publication No. 2001-306029; Date of Publication: Nov. 2, 2001; in the name of Akira Otsuka et al.

* cited by examiner

PLASMA DISPLAY PANEL AND DRIVING METHOD THEREOF

CROSS REFERENCE TO RELATED APPLICATION

This application claims priority to and the benefit of Korea Patent Application No. 2003-27285 filed on Apr. 29, 2003 in the Korean Intellectual Property Office, the content of which is incorporated herein by reference.

BACKGROUND OF THE INVENTION (a) Field of the Invention

The present invention relates to a plasma display panel (PDP) and a driving method thereof.

(b) Description of the Related Art

Recently, liquid crystal displays (LCDs), field emission displays (FEDs), and PDPs have been actively developed. The PDPs from among the flat panel devices have better luminance and light emission efficiency compared to the other types of flat panel devices, and also have wider view angles. Therefore, the PDPs have come into the spotlight as substitutes for the conventional cathode ray tubes (CRTs) in large displays of greater than 40 inches.

A PDP is a flat display for showing characters or images using plasma generated by gas discharge, and pixels numbering to more than several million are provided thereon in a matrix format, according to its size. Referring to FIGS. 1 and 2, a PDP structure will now be described.

FIG. 1 shows a partial perspective view of the PDP. FIG. 2 shows an electrode arrangement of the PDP.

As shown in FIG. 1, the PDP includes glass substrates 1 and 6 facing each other with a predetermined gap therebetween. Scan electrodes 4 and sustain electrodes 5 in pairs are formed in parallel on glass substrate 1. Scan electrodes 4 and sustain electrodes 5 are covered with dielectric layer 2 and protection film 3. A plurality of address electrodes 8 is formed on glass substrate 6. Address electrodes 8 are covered with an insulator layer 7. Barrier ribs 9 are formed on insulator layer 7 between address electrodes 8. Phosphors 10 are formed on the surface of insulator layer 7 and between barrier ribs 9. Glass substrates 1 and 6 are provided facing each other with discharge spaces therebetween so that scan electrodes 4 and sustain electrodes 5 may respectively cross address electrodes 8. Discharge space 11 between address electrodes 8 and a crossing part of the paired scan electrode 4 and sustain electrode 5 forms discharge cell 12.

As shown in FIG. 2, the electrodes of the PDP have an (n×m) matrix format. Address electrodes Al through Am are arranged in the column direction, and n scan electrodes Y1 through Yn and n sustain electrodes X1 through Xn are arranged in pairs in the row direction.

Referring to FIGS. 3 and 4A through 4D, a conventional PDP driving method will be described.

FIG. 3 shows a driving waveform diagram of the conventional PDP, and FIGS. 4A through 4D show distributions of wall charges in respective intervals when using the conventional driving method. That is, FIGS. 4A through 4D show charge distributions corresponding to the driving waveform shown in FIG. 3.

In general, a single frame is divided into a plurality of subfields in the PDP, and the gray is represented by combination of the subfields. As shown in FIG. 3, each subfield has a reset period, an address period, and a sustain period. In the reset period, wall charges formed by previous sustaining are erased, and the wall charges are set up so as to stably perform the next addressing. In the address period, cells that are turned on and those that are turned off are selected, and the wall charges are accumulated to the cells that are turned on (i.e., addressed cells). In the sustain period, sustaining is executed so as to display the actual image to the addressed cells.

When a sustain occurs in the sustain period, wall charges are formed and accumulated at the sustain and scan electrodes, and a discharge cell is sustained by a wall voltage formed by the wall charges and a sustain pulse alternately applied in the sustain period. Through the repetition of the above-noted process, a predetermined number of sustains occur in the sustain period. As described, the conventional method uses a memory function of the wall charges generated and stored at the scan and sustain electrodes to generate a sustain.

Referring to FIG. 3, the conventional reset period includes an erase period, a ramp rising period, and a ramp falling period.

(1) Erase Period

When the final sustain is finished, positive charges are accumulated to the sustain X electrode, and negative charges to the scan Y electrode, as shown in FIG. 4A. Since the address voltage is maintained at 0V (volts) during the sustain period, but it tries to maintain a middle voltage of the sustain all the time, a large amount of the positive charges are accumulated to the address A electrodes.

When the sustain is finished, an erase ramp voltage that gradually increases from 0(V) to+Ve(V) is applied to the sustain X electrode, and the wall charges formed on the sustain X and scan Y electrodes are gradually erased, as shown in FIG. 4B.

(2) Y Ramp Rising Period

During this period, the address A electrode and the sustain X electrode are maintained at 0V, and a ramp voltage is applied to the Y electrode, the ramp voltage gradually rising from voltage Vs that is below the discharge firing voltage with respect to the sustain X electrode to voltage Vset that is over the discharge firing voltage. While the ramp voltage rises, first weak resetting is generated to all the discharge cells from the scan Y electrode to the address A electrode and the sustain X electrode. As a result, the negative wall charges are accumulated to the scan Y electrode, and concurrently, the positive wall charges are accumulated to the address electrode and the sustain X electrode, as shown in FIG. 4C.

(3) Y Ramp Falling Period

In the latter part of the reset period, a ramp voltage that gradually falls from voltage Vs below the discharge firing voltage to 0(V) over the discharge firing voltage with respect to the sustain X electrode is applied to the scan Y electrode under the state that the sustain X electrode maintains a constant voltage Ve. While the ramp voltage falls, second weak resetting is generated from all the discharge cells. As a result, the negative wall charges of the scan Y electrode are reduced, and the polarity of the sustain X electrode is inverted to accumulate weak negative charges thereto, as shown in FIG. 4D. Also, the positive wall charges of the address A electrode are adjusted to an appropriate value for the address operation.

As described, the states of the sustain X electrode, the scan Y electrode, and the address A electrode are processed through the reset period so that they may be suitable for addressing in the address period. However, the address period is reduced because each subfield requires a reset period in the conventional driving method. A long address period is needed for scanning of a high-resolution screen, but it is not easy to display the high-resolution screen through the prior art. Also, discharges occur twice in the reset period, and hence, a constant discharge always exists in the discharge cells that are not turned on, and the total contrast of the screen is lowered.

SUMMARY OF THE INVENTION

In one exemplary embodiment of the present invention, there is provided a PDP driving method without a reset period.

In an exemplary embodiment of the present invention, there is provided a method for driving a PDP including a plurality of first and second electrodes provided in parallel on a first substrate, and a plurality of third electrodes crossing the first and second electrodes and being formed on a second substrate. A plurality of discharge cells is formed by the adjacent first, second, and third electrodes. A single subfield includes an address period for forming wall charges at a discharge cell to be selected from among the discharge cells, and a sustain period for discharging the selected cell. The sustain period includes: applying a first pulse to the second electrode while the first electrode is established as a first voltage; and alternately applying a sustain pulse with a second voltage defined by a voltage difference between the first and second electrodes to the first and second electrodes. The second voltage is less than a voltage difference between the first pulse and the first voltage.

In another exemplary embodiment, the address period of the next subfield follows the sustain period.

In another exemplary embodiment, a discharge occurs at the discharge cell selected in the address period by the first voltage and the first pulse to form a first space charge. The first space charge allows the discharge cell to be discharged by the second voltage.

In yet another exemplary embodiment, the sustain pulse has a width such that the sustain pulse may generate and maintain a second space charge after a discharge has occurred in the selected discharge cell.

In still another exemplary embodiment, the sustain pulse is applied to the one of the first and second electrodes when the second space charge remains in the discharge cell such that the first and second electrode may be discharged by the second voltage.

In a further exemplary embodiment, the first pulse is a square wave with a third voltage level for a predetermined period. A difference between the third voltage level and the first voltage level is within a range for generating a discharge between the first electrode and the second electrode together with a voltage formed by the wall charges formed at the selected discharge cell.

In a yet further exemplary embodiment, a voltage difference between the third voltage level and the first voltage level is within a range during which a discharge between the first and second electrodes cannot occur at the discharge cell that is not selected during the address period.

In a still further exemplary embodiment, the second voltage level is within a range for generating a discharge between the first and second electrodes together with a voltage caused by the wall charges formed at the first and second electrodes.

In another exemplary embodiment of the invention, there is provided a PDP including: first and second substrates; a plurality of first and second electrodes formed in parallel on the first substrate; a plurality of third electrodes crossing the first and second electrodes and being formed on the second substrate; and a driving circuit for driving a single subfield through an address period for forming charges at a discharge cell to be selected from among a plurality of discharge cells formed by the adjacent first, second, and third electrodes, and a sustain period for discharging the selected discharge cell. The driving circuit applies a setup pulse to the second electrode while maintaining the first electrode at a first voltage, and respectively applies first and second sustain pulses with predetermined frequencies to the first and second electrodes during the sustain period. The setup pulse generates a discharge between the first and second electrodes at the selected discharge cell.

In yet another exemplary embodiment, the setup pulse has a waveform for generating a discharge between the first and second electrodes at the selected discharge cell to form a first space charge. A voltage level difference between the first and second sustain pulses when the first sustain pulse has a high-level voltage and a voltage level difference between the second and first sustain pulses when the second sustain pulse has a high-level voltage are a second voltage level. The second voltage level is within a range for establishing the first space charge as a priming particle to generate a discharge between the first and second electrodes.

In still another exemplary embodiment, a period for forming the second voltage by the first and second sustain pulses is within a range for forming a second space charge at the discharge cell by the discharge between the first and second electrodes. The second space charge is the second voltage formed by the level-converted first and second sustain pulses to operate as a priming element for generating a discharge between the first and second electrodes. Frequencies of the first and second sustain pulses are within a range where the second space charges remain such that the second space charges may operate as a priming element of a discharge between the first and second electrodes.

In a further exemplary embodiment of the present invention, there is provided a PDP driving method by forming wall charges at a discharge cell to be selected from among a plurality of discharge cells, and discharging the selected discharge cell, including: applying a setup pulse for forming a first space charge at the selected discharge cell to the discharge cell; and establishing the first space charge formed by the setup pulse as a priming element, and applying a sustain pulse with a voltage level of a range for discharging the selected discharge cell to the discharge cell.

In a still further exemplary embodiment of the present invention, there is provided a PDP driving method by dividing a frame for realizing video signals into a plurality of subfields, the PDP including a plurality of discharge cells. The subfield includes an address period for forming wall charges at a discharge cell to be selected from among the discharge cells, and a sustain period for sustaining the selected discharge cell without using a memory function. The sustain period includes: applying a pulse for discharging the selected discharge cell during the address period; and establishing the discharge as priming, and applying a sustain pulse for alternately sustaining the discharge cell.

In a further exemplary embodiment, an address period of a next subfield follows the sustain period of a subfield.

In still another exemplary embodiment of the present invention, there is provided a PDP including: first and second substrates; a plurality of first and second electrodes formed in parallel on the first substrate; a plurality of third electrodes crossing the first and second electrodes and being formed on the second substrate; and a driving circuit for sustaining a plurality of discharge cells formed by the adjacent first, second, and third electrodes. A frequency of the sustain pulse supplied for sustaining the discharge cell in the driving circuit is greater than 500 KHz.

In yet another exemplary embodiment, the frequency has a range from 500 KHz to 1 MHz, or the frequency has a range from 700 KHz to 1 MHz.

DETAILED DESCRIPTION

Figure 1:
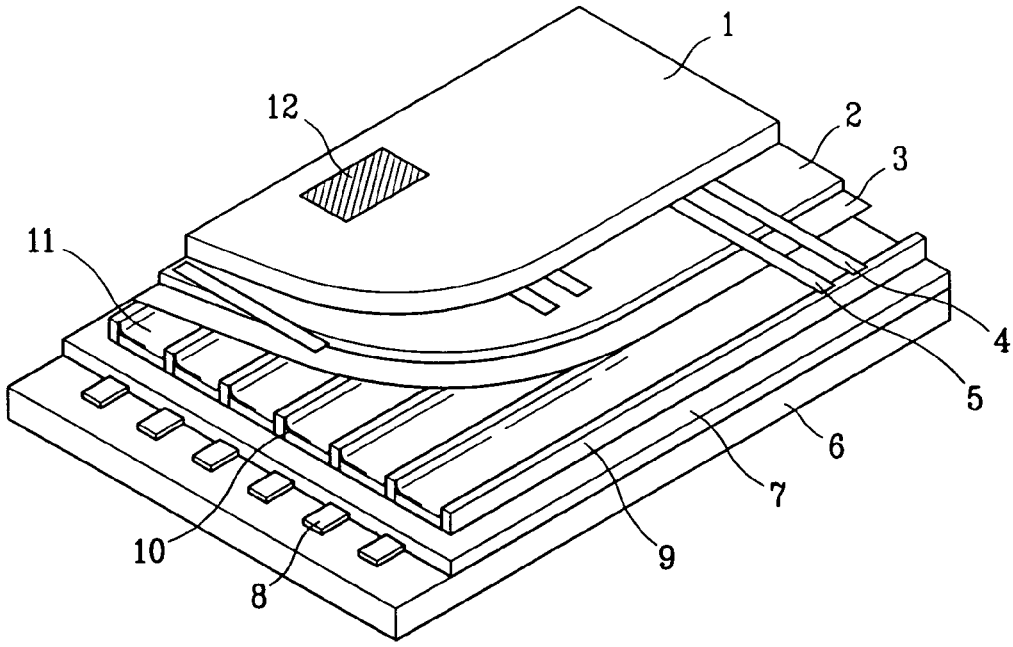
FIG. 1 shows a partial perspective view of a PDP.
Figure 2:
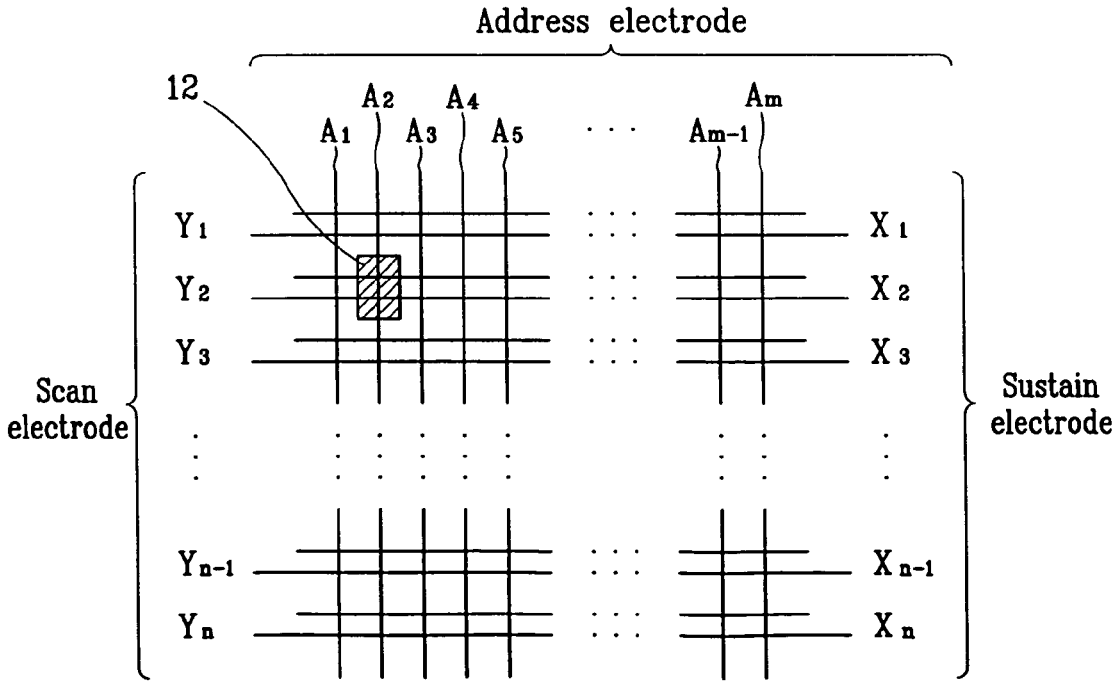
FIG. 2 shows an electrode arrangement diagram of the PDP.
Figure 3:
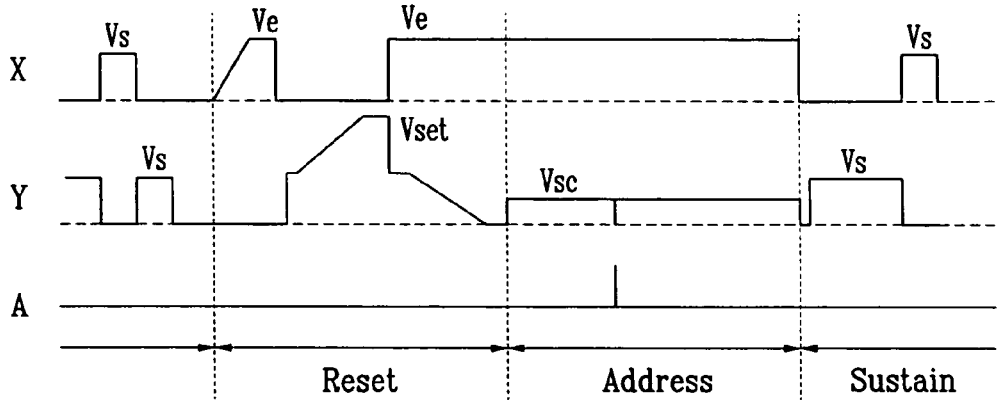
FIG. 3 shows a conventional driving waveform diagram of the PDP.
Figure 4A:
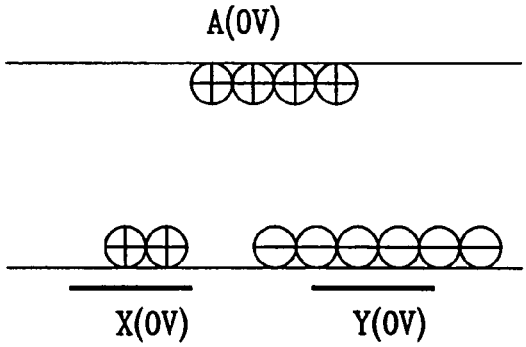
FIGS. 4A through 4D show distribution diagrams of wall charges according to the driving waveform of FIG. 3.
Figure 4B:
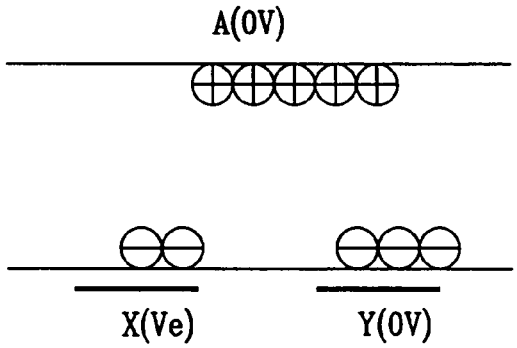
Figure 4C:
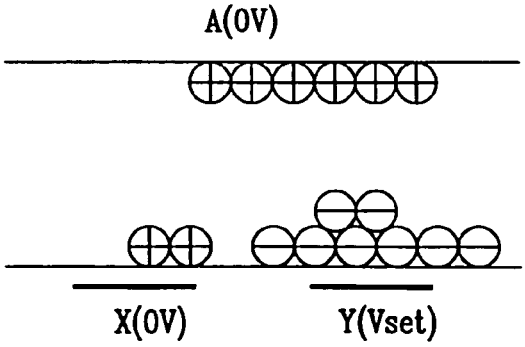
Figure 4D:
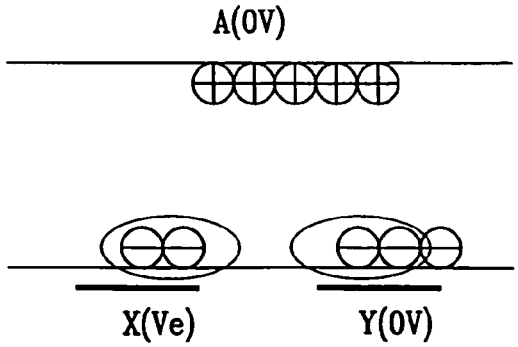
Figure 5:
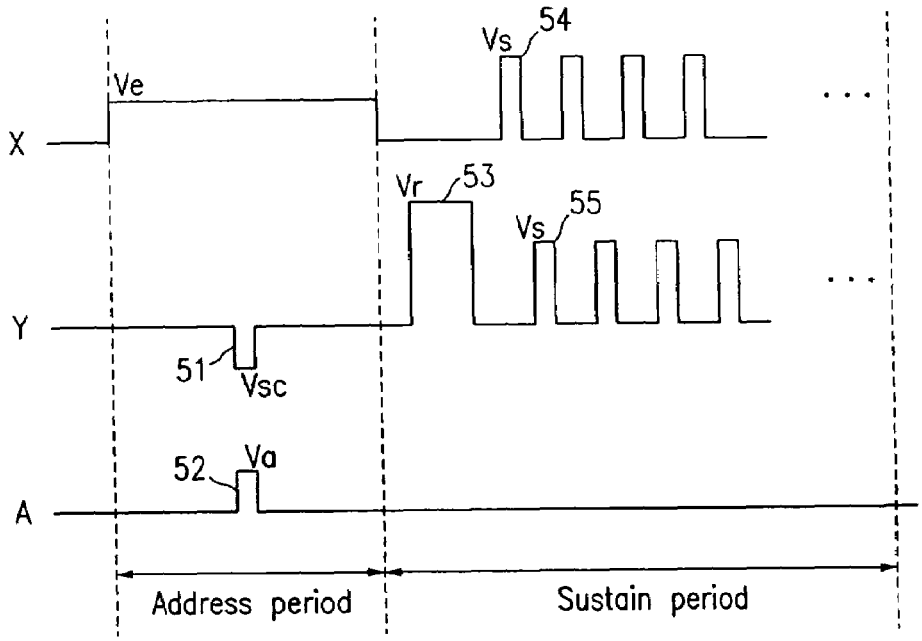
FIG. 5 shows a driving waveform diagram of the PDP according to a first exemplary embodiment of the present invention.
Figure 6A:
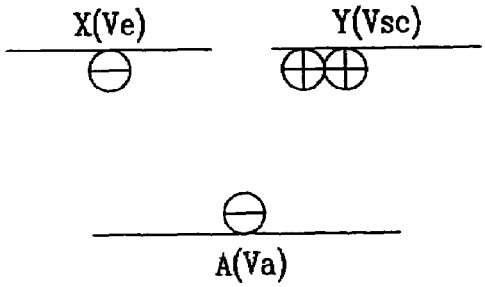
FIGS. 6A through 6D show distribution diagrams of wall charges according to the driving waveform of FIG. 5.

FIG. 5 shows a driving waveform diagram of the PDP according to a first exemplary embodiment of the present invention. FIGS. 6A through 6D show distribution diagrams of wall charges according to the driving waveform of FIG. 5. FIG. 7 shows a discharge caused by a setup pulse in the driving waveform of FIG. 5.

As shown in FIG. 5, a subfield has an address period and a sustain period without a reset period in the PDP driving method according to the first exemplary embodiment of the present invention.

In an address period, scan pulse 51 is sequentially applied to a scan Y electrode, address pulse 52 is applied to an address A electrode, and voltage Ve is being applied to a sustain X electrode. An address discharge is generated at a discharge cell formed by the scan electrode to which scan pulse 51 is applied and the address electrode to which address pulse 52 is applied. The address discharge forms wall charges at the discharge cell.

In a sustain period, setup pulse 53 is applied to a scan electrode, and sustain pulses 54 and 55 are alternately applied to a sustain electrode and a scan electrode. A discharge is generated by setup pulse 53 at the discharge cell at which the wall charges are formed in the address period, to modify a state of the wall charges. The modified state of the wall charges is a state in which a sustain can be generated by sustain pulses 54 and 55 that are subsequently applied. No discharge occurs by setup pulse 53 in a discharge cell at which no address is generated in the address period, and hence, no sustain occurs in it when sustain pulses 54 and 55 are applied thereto.

The PDP comprises an address drive circuit for applying an address pulse 52 to the address electrode, and a scan/sustain drive circuit for applying scan pulse 51, setup pulse 53, and sustain pulses 54 and 55 to the scan electrode and the sustain electrode.

Referring to FIGS. 5, 6A through 6D, and 7, a discharge process at a discharge cell to which an address pulse and a scan pulse are applied and which is then selected will be described in detail. For ease of description, a single discharge cell including a sustain X electrode, a scan Y electrode, and an address A electrode to which voltage Ve, a scan pulse, and an address pulse are respectively applied is illustrated in FIGS. 5 and 6A through 6D.

Referring to FIG. 5, voltage Ve is applied to the sustain electrode. Scan pulse 51 with voltage Vsc is applied to the scan electrode. Address pulse 52 with voltage Va is applied to the address electrode in the address period. Voltage Ve of the sustain electrode and voltage Va of the address electrode are greater than a reference voltage (0V in FIG. 5). Voltage Vsc of the scan electrode is less than the reference voltage. Voltage Va is a voltage for generating a surface discharge between the address electrode and the scan electrode by a difference between voltage Va and voltage Vsc. A voltage difference between Ve and Vsc is less than a discharge firing voltage between the sustain electrode and the scan electrode.

Therefore, a discharge occurs between the address electrode and the scan electrode by a voltage difference between voltage Va of the address electrode and voltage Vsc of the scan electrode. A discharge occurs between the scan electrode and the sustain electrode by priming the discharge between the address electrode and the scan electrode. As shown in FIG. 6A, negative charges are accumulated at the address electrode and the sustain electrodes. A large volume of positive charges are accumulated at the scan electrode, by the discharge between the address electrode and the scan electrode and the discharge between the sustain electrode and the scan electrode.

Figure 6B:
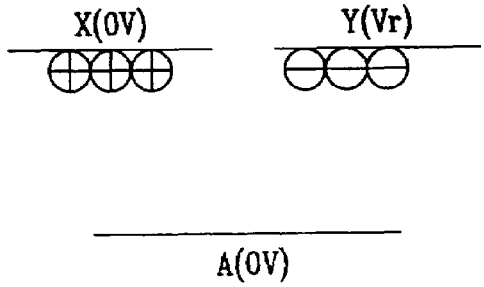
Figure 7:
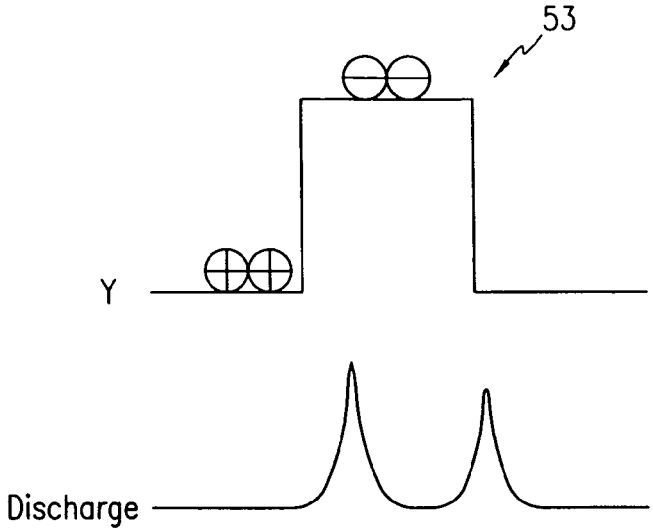
FIG. 7 shows a discharge caused by a setup pulse in the driving waveform of FIG. 5.

Referring to FIGS. 5, 6B, and 7, setup pulse 53 with high voltage Vr is applied to the scan electrode, and a reference voltage is applied to the sustain electrode and the address electrode. When setup pulse 53 rises, a discharge mainly occurs between the sustain electrode and the scan electrode by a wall voltage caused by wall charges of the sustain electrode and the scan electrode, and voltage Vr of the setup pulse generates an amount of negative charges greater than that of the negative charges during the address period by high-voltage setup pulse 53, and accordingly, large amounts of positive charges and negative charges are respectively accumulated at the sustain electrode and the scan electrode as shown in FIG. 6B.

Figure 6C:
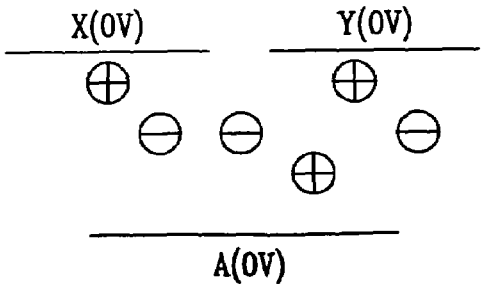
Figure 6D:
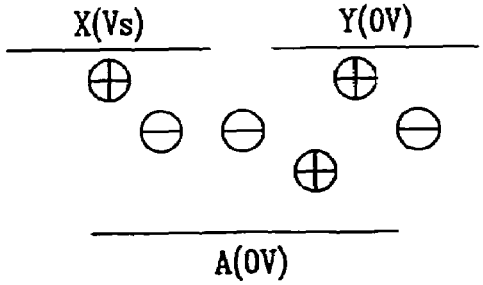

As shown in FIG. 7, when setup pulse 53 applied to the scan electrode falls, a self discharge occurs between the sustain electrode and the scan electrode because of the wall charges accumulated at the sustain electrode and the scan electrode. According to the self discharge, a space charge is formed at the discharge cell as shown in FIG. 6C.

Next, sustain pulse 54 with voltage Vs is applied to the sustain electrode of the discharge cell at which the space charge is formed, and reference voltage 0V is applied to the scan electrode. Here, the space charge operates as a priming particle to reduce a voltage for firing a sustain. When voltage Vs less than discharge firing voltage Vf is applied while the space charge remains in the discharge cell, an effective voltage formed by the space charge and voltage Vs becomes greater than discharge firing voltage Vf to generate the sustain. In this instance, voltage Vs is a minimum voltage for generating a sustain in the sustain period, and it will be referred to as a sustain voltage hereinafter.

When a period for sustain pulse 54 to maintain voltage Vs is short, the charges generated by the sustain are not accumulated to the sustain electrode and the scan electrode, but remain at the discharge cell as space charges.

Sustain pulse 55 with voltage Vs is applied to the scan electrode while the space charges caused by sustain pulse 54 applied to the sustain electrode remain in the discharge cell, and then, the effective voltage formed by the space charges and voltage Vs becomes greater than discharge firing voltage Vf to generate a sustain at the discharge cell. When sustain pulse 54 applied to the scan electrode has a short period for maintaining voltage Vs, the charges generated by the sustain are not accumulated at the sustain electrode and the scan electrode, but remain at the discharge cell as space charges. In the first exemplary embodiment as described above, few wall charges are stored in the sustain electrode and the scan electrode by the sustain, differing from the prior art, and the space charges that exist for a short time at the discharge cell are used to generate a sustain. That is, the sustain is generated without using the memory function of the wall charges. A small amount of wall charges can be generated in the first exemplary embodiment, but the wall charges are not so many as to be used for the memory effect described in the prior art.

According to the first embodiment, the conventional reset period is not needed since no wall charges are formed at the sustain electrode and the scan electrode when the sustain period of a single subfield is finished. That is, an operation corresponding to the address period is executed when the sustain period is finished.

A setup pulse is applied to the previously selected discharge cell in the sustain period of the driving waveform according to the first embodiment to thus form space charges, and a sustain pulse is applied while the space charges remain in the discharge cell to thereby generate a sustain. It is desirable for the sustain pulse to have a short width such that the charges formed by a discharge are not accumulated at the sustain electrode and the scan electrode. It is also desirable for the sustain pulse to have a short period (a high frequency) so that the sustain pulse may be applied again while the space charges formed by a sustain remain.

Referring to FIGS. 8 and 9A through 9D, a discharge cell which is not selected since no address pulse is applied will be described.

Figure 8:
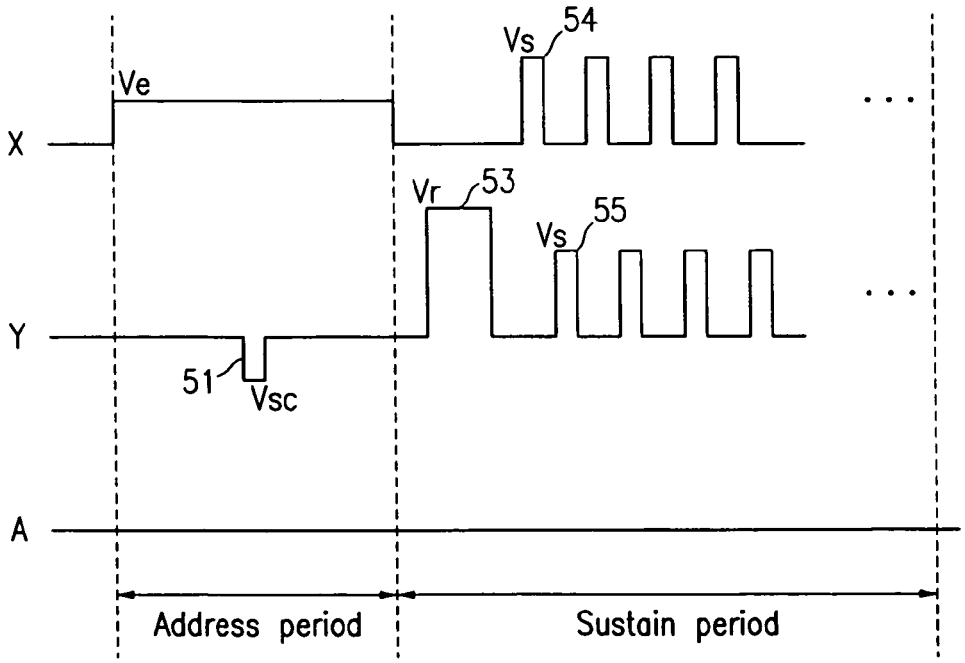
FIG. 8 shows a diagram of a driving waveform applied to a discharge cell that is not selected.

FIG. 8 shows a diagram of a driving waveform applied to a discharge cell that is not selected, and FIGS. 9A through 9D show distribution diagrams of wall charges according to the driving waveform of FIG. 8.

Figure 9A:
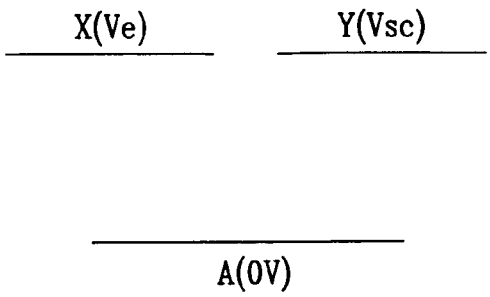
FIGS. 9A through 9D show distribution diagrams of wall charges according to the driving waveform of FIG. 8.

As shown in FIG. 8, no address pulse is applied to the address electrode of the discharge cell that is not selected, and no discharge is accordingly generated between the address electrode and the scan electrode, and since the voltage difference Ve-Vsc between the sustain electrode and the scan electrode is less than discharge firing voltage Vf, no discharge occurs between the sustain electrode and the scan electrode. Hence, as shown in FIG. 9A, no wall charges are formed when scan pulse 51 is only applied to the scan electrode.

Figure 9B:
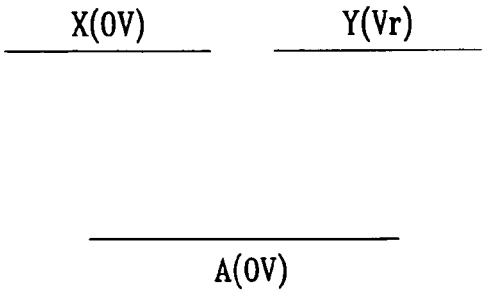
Figure 9C:
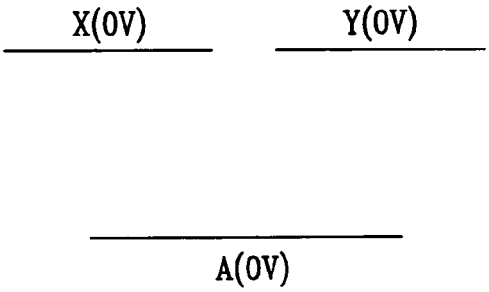

Next, since there are no wall charges at the sustain electrode and the scan electrode when setup pulse 53 is applied to the scan electrode in the sustain period, no discharge occurs between the sustain electrode and the scan electrode by only voltage Vr of setup pulse 53. As shown in FIG. 9B, therefore, no wall charges are formed while setup pulse 53 is applied. Since no wall charges are at the sustain electrode and the scan electrode, no discharge occurs when setup pulse 53 falls, and hence, no charges are formed at the discharge cell, as shown in FIG. 9C.

Figure 9D:
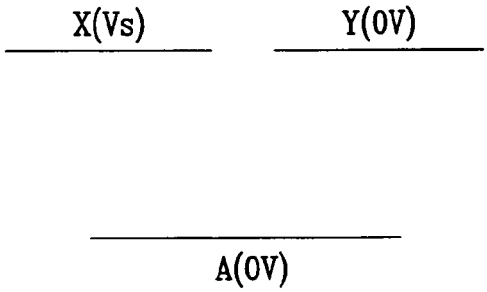

When sustain pulse 54 with voltage Vs less than discharge firing voltage Vf is applied to the sustain electrode, no sustain occurs since no space charges are provided at the discharge cell, and accordingly, no space charges are formed at the discharge cell as shown in FIG. 9D.

Since no discharge occurs in the discharge cell to which no address pulse 52 is applied in the address period, no wall charges are formed, and no space charges are formed in the discharge cell by setup pulse 53. In the case no space charges operating as priming particles are formed as described, no sustain occurs when sustain pulse 54 with voltage Vs less than discharge firing voltage Vf is alternately applied to the sustain electrode and the scan electrode.

According to the first embodiment, the conventional reset period can be eliminated, the sustain period can be reduced since the frequency of the sustain pulse is high, and high resolution can be realized by increasing the address period by eliminating the reset period and reducing the sustain period. Also, high grays can be displayed and contour noise can be reduced since a large number of subfields can be allocated to a single frame, the number of sustain pulses provided in a single subfield can be increased since the frequency of the sustain pulse is high, and the contrast can be improved since no discharge exists in the discharge cell that is not selected.

A square wave with a long width of voltage state Vr is used for the setup pulse in the first exemplary embodiment, and other types of waveforms can also be used, which will be described in detail with reference to FIGS. 10 through 12.

Figure 10:
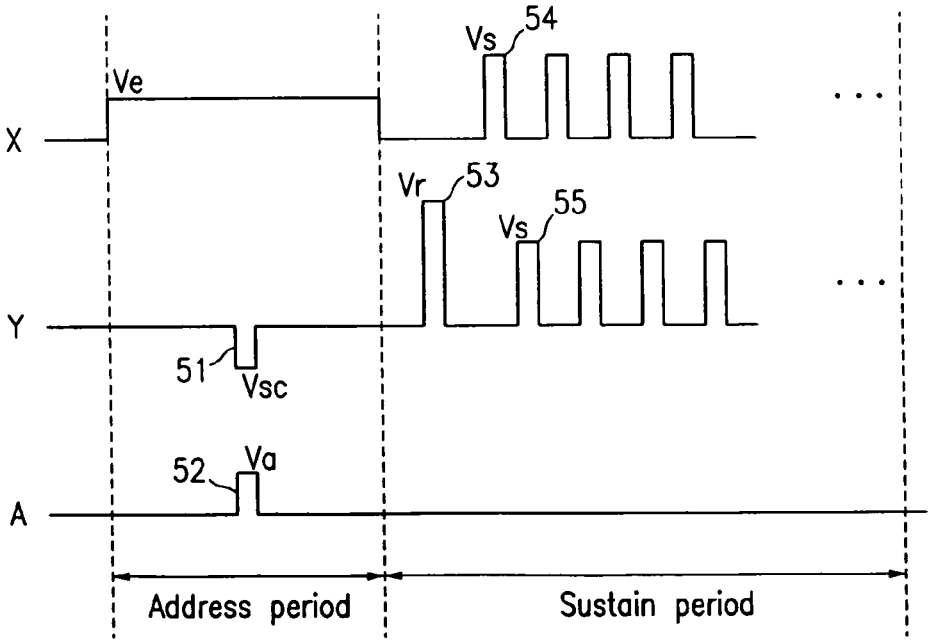
FIGS. 10 through 13 show PDP driving waveform diagrams according to second through fifth exemplary embodiments of the present invention.
Figure 11:
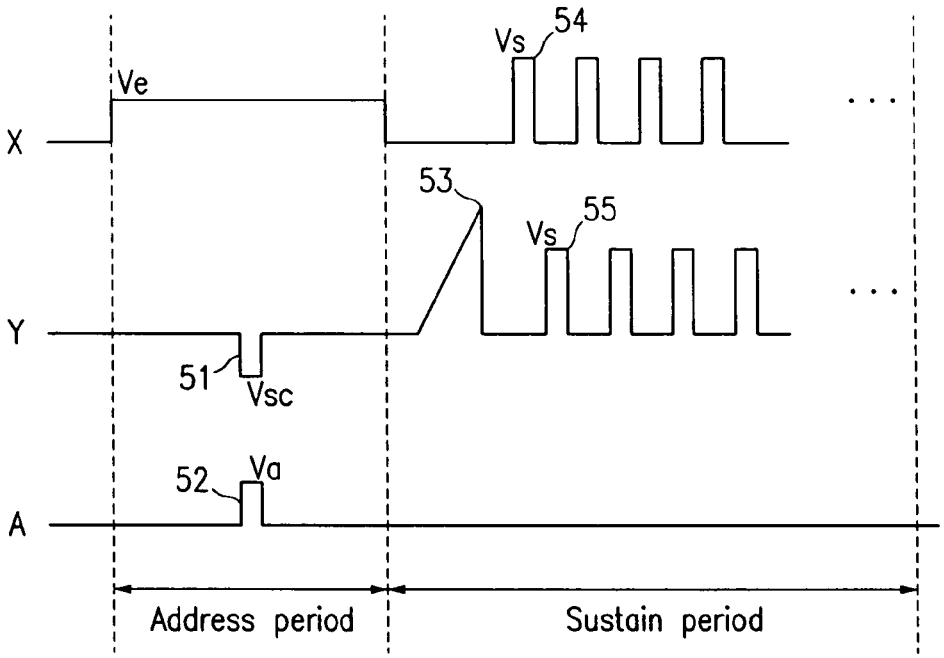
Figure 12:
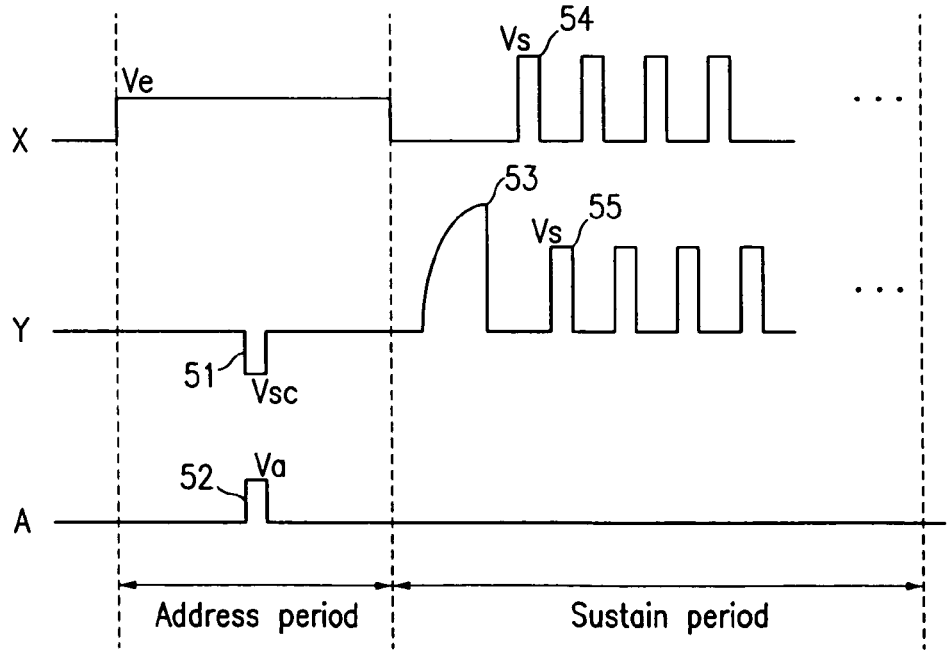

FIGS. 10 through 12 show PDP driving waveform diagrams according to second through fourth exemplary embodiments of the present invention.

Referring to FIG. 10, the setup pulse in the driving waveform according to the second exemplary embodiment has a square waveform with a narrow width in voltage state Vr. A discharge occurs between the sustain electrode and the scan electrode by voltage Vr of the setup pulse, and the charges formed by the discharge are not accumulated as wall charges at the sustain electrode and the scan electrode but remain as space charges because of the narrow width of the setup pulse.

Referring to FIG. 11, the setup pulse in the driving waveform according to the third exemplary embodiment is a gradually rising ramp waveform. When the voltage applied to the scan electrode gradually rises to voltage Vr, a discharge occurs between the scan electrode and the sustain electrode to accumulate wall charges at the scan electrode and the sustain electrode. When the ramp waveform falls to the reference voltage, a self discharge occurs because of the wall charges accumulated at the scan electrode and the sustain electrode to form the space charge at the discharge cell.

As shown in FIG. 12, the setup pulse in the driving waveform according to the fourth exemplary embodiment is a curvedly rising round waveform. Since the discharge phenomenon caused by the round waveform is similar to that caused by the ramp waveform of FIG. 11, no corresponding description will be provided.

Other types of setup pulses can also be used if the space charges can be formed together with the wall charges formed in the address period, in addition to the setup pulses used in the first through fourth exemplary embodiments.

The space charges are used to generate a sustain in the sustain period in the first through fourth exemplary embodiments, and further, the sustain can be generated using the wall charges in the sustain period, which will be described in detail with reference to FIG. 13.

Figure 13:
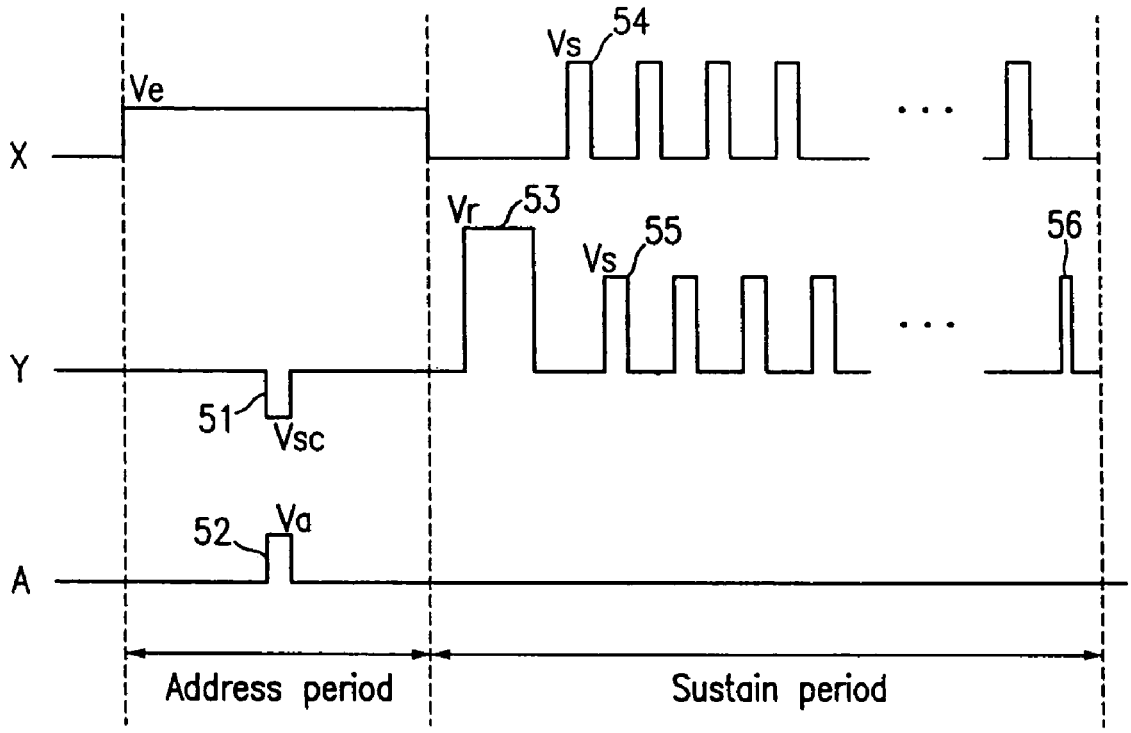

FIGS. 13 shows a PDP driving waveform diagram according to the fifth exemplary embodiment of the present invention.

Widths of sustain pulses 54 and 55 in the fifth exemplary embodiment are longer than those of sustain pulses 54 and 55 in the first exemplary embodiment. When sustain pulse 54 is applied to the sustain electrode while space charges are formed by setup pulse 53 at the discharge cell selected in the address period, a discharge occurs between the sustain electrode and the scan electrode. Since the width of sustain pulse 54 is long, the charges formed by the discharge are accumulated as wall charges at the sustain electrode and the scan electrode. When sustain pulse 55 is applied to the scan electrode, a discharge occurs between the sustain electrode and the scan electrode by a wall voltage caused by the wall charges of the sustain electrode and the scan electrode and voltage Vs. When the width of sustain pulse 55 is long, the charges formed by the discharge are accumulated as wall charges at the sustain electrode and the scan electrode.

As described, wall charges are formed at the sustain electrode and the scan electrode by a sustain, and a discharge between the sustain electrode and the scan electrode occurs according to a wall voltage caused by the wall charges and a voltage cause by the sustain pulse in the fifth exemplary embodiment. When the width of sustain pulse 56 finally applied to the scan electrode is shortened, the charges formed by the discharge caused by sustain pulse 56 are not accumulated at the sustain electrode and the scan electrode.

The first through fifth exemplary embodiments are described by establishing ground potential 0V as a reference voltage, and without being restricted to this, other pulses with different levels can be used if the same discharge characteristics are possible. For example, a pulse with voltages of Vs/2 and −Vs/2 can be used as sustain pulses 54 and 55 instead of using a pulse with voltages of Vs and 0V. Sustain pulse 55 is defined to have voltage −Vs/2 when sustain pulse 54 has voltage Vs/2, and sustain pulse 55 is defined to have voltage Vs/2 when sustain pulse 54 has voltage −Vs/2. Also, the space charges can be generated by a sustain pulse by reducing a period during which a voltage difference of sustain pulses 54 and 55 is voltage Vs.

Therefore, the conventional reset period can be eliminated by following the exemplary embodiments of the present invention. Application of a time corresponding to the eliminated reset period to the address period allows an increase of the address period, thereby enabling an addressing for a high-resolution screen. Also, execution of a sustain by use of the space charges reduces the period of the sustain pulse, thereby reducing the sustain period. As described, when the sustain period is reduced and the reset period is eliminated, a large number of subfields can be allocated to a single frame, thereby allowing display of high gray and reducing contour noise. In addition, the contrast is improved since no discharge exists in the discharge cell that is not selected.

When the frequencies of sustain pulses 54 and 55 are increased, or a period during which a voltage difference of sustain pulses 54 and 55 is defined as voltage Vs is reduced, the sustain can occur when sustain voltage Vs is lowered.

Figure 14:
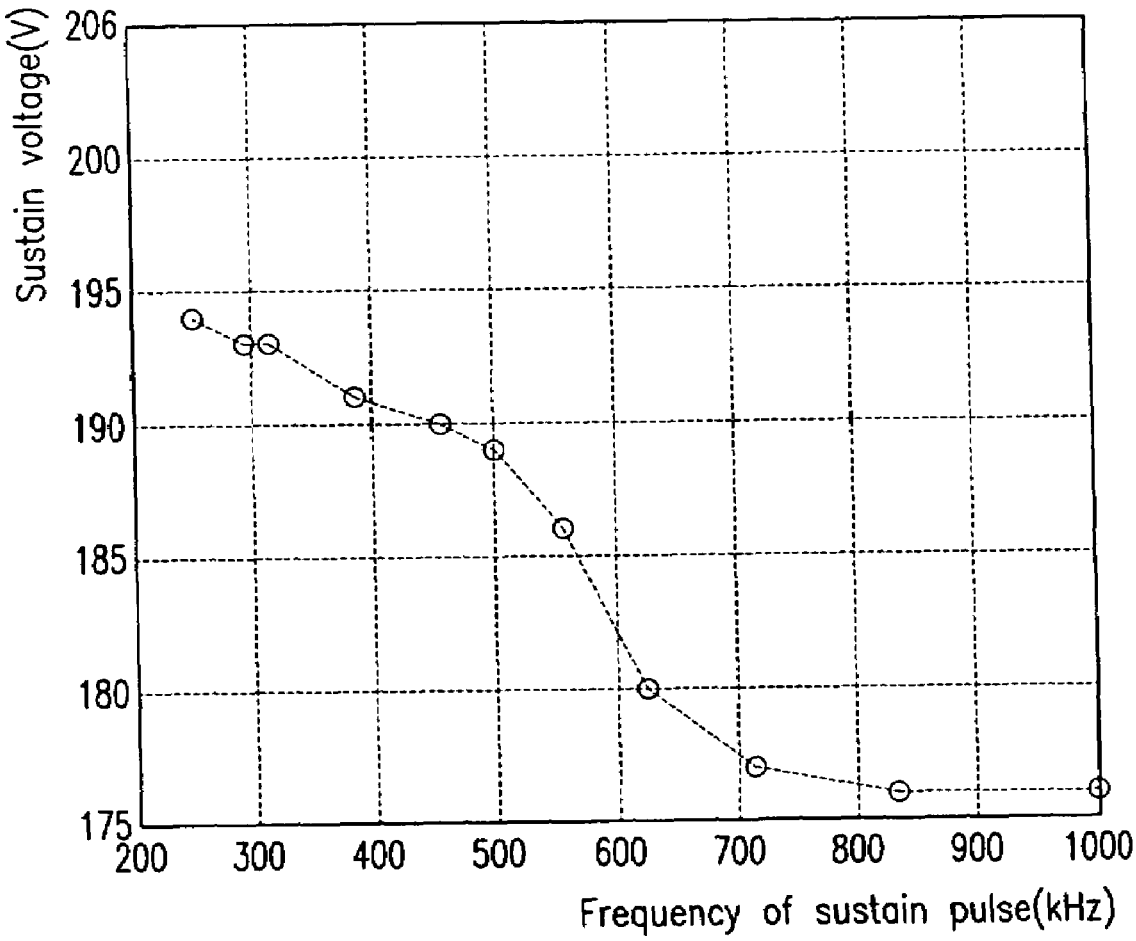
FIG. 14 shows a relationship between a frequency of the sustain pulse and a sustain voltage according to an exemplary embodiment of the present invention.
Figure 15:
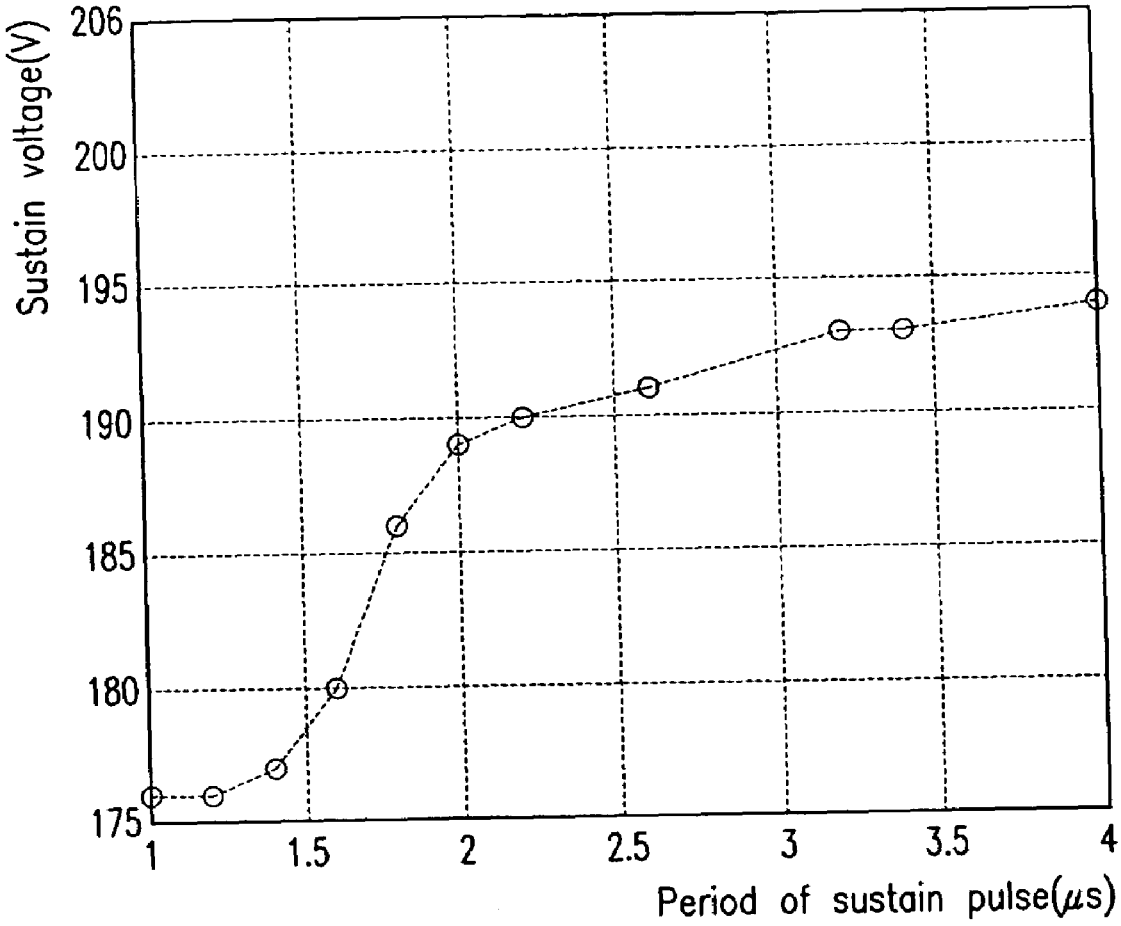
FIG. 15 shows a relationship between a period of the sustain pulse and a sustain voltage according to an exemplary embodiment of the present invention.
Figure 16:
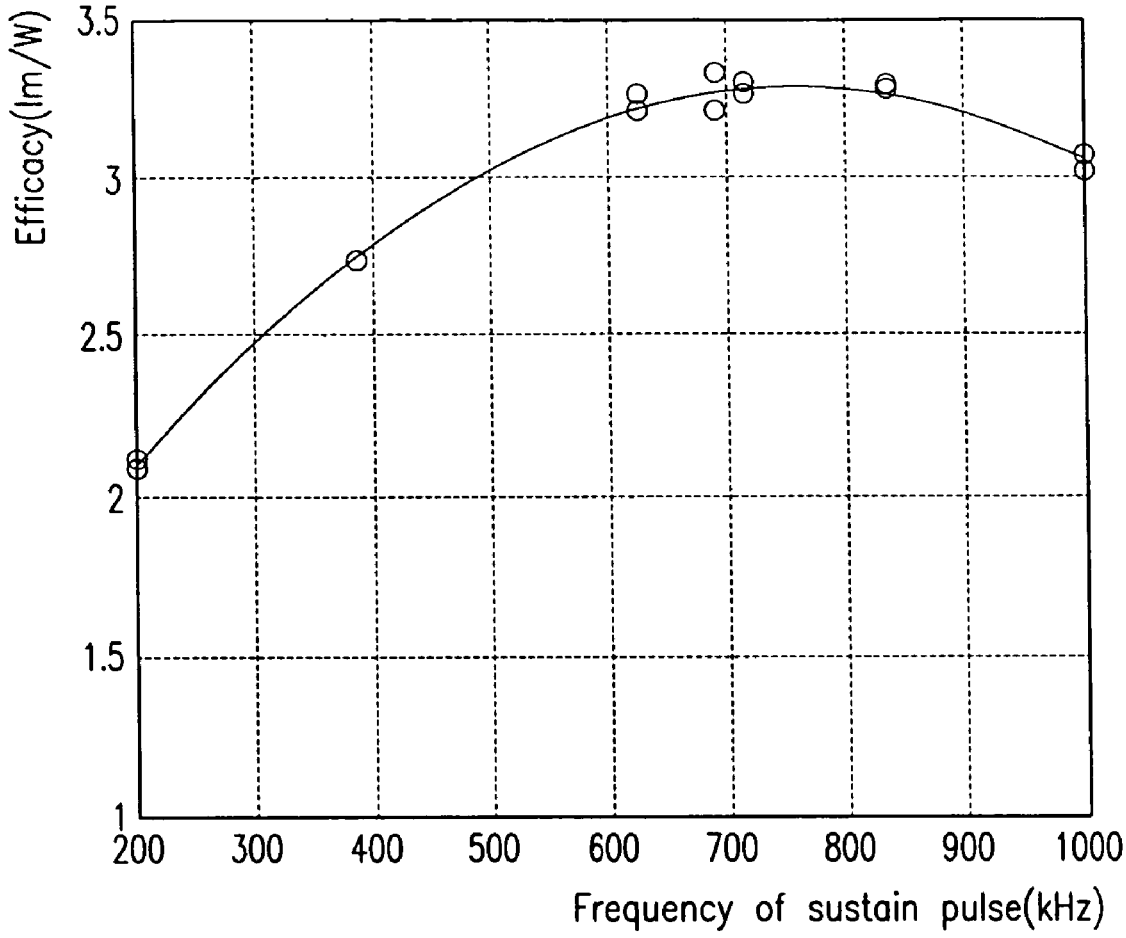
FIG. 16 shows a relationship between a frequency of the sustain pulse and an efficacy according to an exemplary embodiment of the present invention.

FIG. 14 shows a relationship between a frequency of the sustain pulse and a sustain voltage according to an exemplary embodiment of the present invention. FIG. 15 shows a relationship between a period of the sustain pulse and a sustain voltage according to an exemplary embodiment of the present invention. FIG. 16 shows a relationship between a frequency of the sustain pulse and an efficacy according to an exemplary embodiment of the present invention. In the experimental conditions of FIGS. 14 through 16, a display area is 24[mm]×44[mm], a length of a subfield is 1.67 ms, a tension of Xe is 35%, and a test pattern is full white.

Referring to FIGS. 14 and 15, predetermined amounts of wall charges are formed at the scan electrode and the sustain electrode by a sustain pulse such that the wall charges mainly influence the sustain in an area where frequencies of sustain pulses 54 and 55 are less than 500 Hz, that is, the area where the periods of sustain pulses 54 and 55 are greater than 2 μs. Small amounts or few wall charges are formed at the scan electrode and the sustain electrode by a sustain pulse in an area where frequencies of sustain pulses 54 and 55 are greater than 500 Hz, that is, the area where the periods of sustain pulses 54 and 55 are less than 2 μs, and accordingly, the space charges existing in the discharge cell mainly influence the sustain. That is, the area where frequencies are greater than 500 Hz, or the area where the periods are less than 2 μs becomes an area for generating a sustain with the space charges as main elements compared to the wall charges.

Referring to FIG. 14, it is found that sustain voltage Vs almost linearly reduces as a frequency increases in the area where the frequencies of sustain pulses 54 and 55 are less than 500 Hz, but a reducing speed of sustain voltage Vs increases as the frequencies become greater than 500 Hz. That is, sustain voltage Vs steeply reduces in the case when the frequency domain where the space charges operate as main elements is greater than 500 Hz.

In the area where the frequency is greater than 700 Hz, sustain voltage Vs becomes almost constant being from 176 to 177V, and hence, the sustain can occur with low sustain voltage Vs. When the frequencies of sustain pulses 54 and 55 become greater than 1 MHz, much electromagnetic interference (EMI) can occur in a driving circuit for generating sustain pulses 54 and 55.

Referring to FIG. 16 and Table 1, the efficacy increases when the frequencies of sustain pulses 54 and 55 increase. The efficacy is determined by a relationship between a power used for a case when a discharge occurs by a single sustain pulse, and a luminance. As shown, the efficacy becomes greater than 3 in the area where the frequency is greater than 500 Hz, obtaining a high efficacy.

TABLE 1

| Frequency (kHz) | Current*Voltage (A*V) | Luminance (cd/m$^2$) | Efficacy (Im/W) |
|---|---|---|---|
| 1000 | 1.78E−05 | 628.0 | 3.04 |
| 833 | 1.83E−05 | 696.0 | 3.28 |
| 714 | 2.20E−05 | 829.0 | 3.27 |
| 690 | 2.23E−05 | 830.0 | 3.22 |
| 625 | 2.56E05 | 951.0 | 3.21 |
| 556 | 2.91E−05 | 1069.5 | 3.17 |
| 385 | 3.41E05 | 1073.5 | 2.72 |
| 200 | 4.41E05 | 1075.0 | 2.10 |

While this invention has been described in connection with what is presently considered to be the most practical and exemplary embodiments, it is to be understood that the invention is not limited to the disclosed embodiments, but, on the contrary, is intended to cover various modifications and equivalent arrangements included within the spirit and scope of the appended claims.

What is claimed is:

1. A method for driving a plasma display panel including a plurality of first electrodes and second electrodes in parallel on a first substrate, and a plurality of third electrodes crossing the first electrodes and second electrodes and being on a second substrate, wherein a plurality of discharge cells is formed by first electrodes, second electrodes, and third electrodes, and wherein a single subfield includes an address period for forming wall charges at a discharge cell to be selected from among the discharge cells, and a sustain period for discharging the selected cell, the method comprising:

in the sustain period:

applying a first pulse to a second electrode of the plurality of second electrodes while a first electrode of the plurality of first electrodes is established at a first voltage; and alternately applying to the first electrodes and the second electrodes a sustain pulse with a second voltage defined by a voltage difference between the first electrodes and the second electrodes, wherein the second voltage is less than a voltage difference between the first pulse and the first voltage.

2. The method of claim 1, wherein the address period of a next subfield follows the sustain period.

3. The method of claim 1, wherein a discharge occurs at the discharge cell selected in the address period by the first voltage and the first pulse to form a first space charge and the first space charge allows the discharge cell to be discharged by the second voltage.

4. The method of claim 3, wherein the second voltage is less than a discharge firing voltage between the first electrodes and the second electrodes at a discharge cell that is not selected.

5. The method of claim 3, wherein the sustain pulse has a width such that the sustain pulse may generate and maintain a second space charge after a discharge has occurred in the selected discharge cell.

6. The method of claim 5, wherein the sustain pulse is applied to the one of the first electrodes and the second electrodes when the second space charge remains in the discharge cell such that the first electrode and the second electrode may be discharged by the second voltage.

7. The method of claim 3, wherein:

the sustain pulse comprises a second pulse that is applied to the first electrode and alternately has a third voltage and a fourth voltage, and a third pulse that is applied to the second electrode and alternately has a fifth voltage and a sixth voltage, and a difference between the third voltage and the fifth voltage and a difference between the sixth voltage and the fourth voltage is defined as the second voltage.

8. The method of claim 3, wherein:

the first pulse is a square wave with a third voltage for a predetermined period, and a difference between the third voltage and the first voltage is within a range for generating a discharge between the first electrode and the second electrode together with a voltage formed by the wall charges formed at the selected discharge cell.

9. The method of claim 8, wherein:

the predetermined period has an interval during which the charges formed by the discharge between the first and second electrodes may be accumulated at the first and second electrodes, and when the first pulse falls from the third voltage, a discharge occurs in the discharge cell because of the charges accumulated at the first electrodes and second electrodes to form the first space charge.

10. The method of claim 8, wherein the predetermined period has an interval such that the charges formed by the discharge between the first electrodes and second electrodes may remain as the first space charge.

11. The method of claim 8, wherein a voltage difference between the third voltage and the first voltage is within a range during which a discharge between the first electrodes and second electrodes cannot occur at the discharge cell that is not selected during the address period.

12. The method of claim 3, wherein:

the first pulse is a waveform that gradually rises to a third voltage, a voltage difference between the third voltage and the first voltage is a voltage such that it may generate a discharge between the first electrodes and the second electrodes, and when the first pulse falls from the third voltage, a discharge occurs by the charges accumulated in the first electrodes and the second electrodes caused by the discharge between the first and second electrodes to form the first space charge.

13. The method of claim 12, wherein the first pulse is a linearly rising ramp waveform.

14. The method of claim 12, wherein the first pulse is a curvedly rising round waveform.

15. The method of claim 12, wherein a voltage difference between the third voltage and the first voltage is within a range during which a discharge between the first electrodes and the second electrodes cannot occur at the discharge cell that is not selected during the address period.

16. The method of claim 3, wherein the sustain pulse has a width such that wall charges may be formed at the first electrodes and the second electrodes after the discharge occurs at the selected discharge cell.

17. The method of claim 16, wherein the second voltage is within a range for generating a discharge between the first electrodes and the second electrodes together with a voltage caused by the wall charges formed at the first and second electrodes.

18. The method of claim 17, wherein a last pulse applied to one of the first electrodes and the second electrodes in the sustain period has a width such that no wall charges may be formed at the first electrodes and the second electrodes.

19. A plasma display panel comprising:

a first substrate and a second substrate;

a plurality of first electrodes and second electrodes formed in parallel on the first substrate;

a plurality of third electrodes crossing the first electrodes and the second electrodes and being formed on the second substrate; and a driving circuit for driving a single subfield through an address period for forming charges at a discharge cell to be selected from among a plurality of discharge cells formed by first electrodes, second electrodes, and third electrodes, and a sustain period for discharging the selected discharge cell, wherein during the sustain period, the driving circuit applies a setup pulse to the second electrodes while maintaining the first electrodes at a first voltage, and respectively applies first sustain pulses and second sustain pulses with predetermined frequencies to the first electrodes and the second electrodes during the sustain period, and the setup pulse generates a discharge between the first electrodes and the second electrodes at the selected discharge cell, wherein the setup pulse has a waveform for generating a discharge between the first electrodes and the second electrodes at the selected discharge cell to form a first space charge, a voltage level difference between the first sustain pulses and the second sustain pulses when the first sustain pulse has a high-level voltage and a voltage level difference between the second sustain pulses and the first sustain pulses when the second sustain pulse has a high-level voltage are a second voltage, and the second voltage is within a range for establishing the first space charge as a priming particle to generate a discharge between the first and second electrodes.

20. The plasma display panel of claim 19, wherein, during the address period:

the driving circuit respectively applies a fourth voltage and a fifth voltage to the second electrode and the third electrode of the discharge cell to be selected while maintaining the first electrode at a third voltage, a voltage difference between the fifth voltage and the fourth voltage is within a range for generating a discharge between the second and third electrodes, and a voltage difference between the third voltage and the fourth voltage is within a range for establishing a discharge between the second and third electrodes as priming and generating a discharge between the first and second electrodes.

21. The plasma display panel of claim 19, wherein:

the setup pulse is a square wave with a third voltage, a discharge between the first electrodes and the second electrodes occurs at a selected discharge cell when the square wave rises, wall charges are formed at the first and second electrodes by the discharge between the first electrodes and the second electrodes while the square wave maintains the third voltage, and a discharge between the first electrodes and the second electrodes is generated by the wall charges formed at the first electrodes and the second electrodes when the square wave falls.

22. The plasma display panel of claim 19, wherein:

the setup pulse is a square wave with a third voltage, and the square wave has a width within a range where the charges formed by the discharge between the first electrodes and the second electrodes may remain as the first space charges at the selected discharge cell.

23. The plasma display panel of claim 19, wherein:

the setup pulse is a waveform gradually rising to a third voltage, a voltage difference between the third voltage and the first voltage is a voltage such that a discharge between the first electrodes and the second electrodes may occur at the selected discharge cell, and a discharge occurs by the charges accumulated at the first electrodes and the second electrodes when the setup pulse falls to form the first space charges.

24. The plasma display panel of claim 19, wherein:

a period for forming the second voltage by the first sustain pulses and the second sustain pulses is within a range for forming a second space charge at the discharge cell by the discharge between the first electrodes and the second electrodes, the second space charge is the second voltage formed by the level-converted first sustain pulses and the second sustain pulses to operate as a priming element for generating a discharge between the first electrodes and the second electrodes, and frequencies of the first sustain pulses and the second sustain pulses are within a range where the second space charges remain such that the second space charges may operate as a priming element of a discharge between the first electrodes and the second electrodes.

25. The plasma display panel of claim 19, wherein:

a period for forming the second voltage by the first sustain pulses and the second sustain pulses is within a range for forming wall charges at the first electrodes and the second electrodes by the discharge between the first electrodes and the second electrodes, and a discharge between the first electrodes and the second electrodes occurs by a voltage formed by the wall charges and the second voltage formed by the level-converted first sustain pulses and the second sustain pulses.

26. The plasma display panel of claim 25, wherein a last pulse applied to one of the first electrodes and the second electrodes has a width of a range during which no wall charges are formed at the first electrodes and the second electrodes by the discharge between the first electrodes and the second electrodes, during the sustain period.

27. A plasma display panel driving method by forming wall charges at a discharge cell to be selected from among a plurality of discharge cells, and discharging the selected discharge cell, comprising:

applying a setup pulse for forming a first space charge at a selected discharge cell to the discharge cell; and establishing the first space charge formed by the setup pulse as a priming element, and applying a sustain pulse to the discharge cell, wherein the sustain pulse has a voltage level of a range for discharging the selected discharge cell when the priming element exists in the selected discharge cell.

28. The plasma display panel driving method of claim 27, wherein:

the sustain pulse has a width of a range for forming a second space charge after the selected discharge cell is discharged by the sustain pulse, and the second space charge formed by the sustain pulse is set as a priming element, a level of the sustain pulse is converted, and the level-converted sustain pulse is applied to the discharge cell within a range where the second space charges remain so that the selected discharge cell may be discharged.

29. A plasma display panel driving method by dividing a frame for realizing video signals into a plurality of subfields, the plasma display panel including a plurality of discharge cells, wherein a subfield includes an address period for forming wall charges at a discharge cell to be selected from among the discharge cells, and a sustain period for sustaining the selected discharge cell without using a memory function, the sustain period being subsequent to the address period, the method comprising:

in the sustain period:

applying a pulse for discharging the selected discharge cell to the discharge cells to generate priming; and applying a sustain pulse to the discharge cell to sustain the selected discharge cell by using the priming.

30. The plasma display panel driving method of claim 29, wherein an address period of a next subfield follows the sustain period of a subfield.

31. A plasma display panel comprising:

a first substrate and a second substrate;

a plurality of first electrodes and second electrodes formed in parallel on the first substrate;

a plurality of third electrodes crossing the first and second electrodes and being formed on the second substrate; and a driving circuit for sustaining a plurality of discharge cells formed by adjacent first electrodes, second electrodes, and third electrodes, wherein to maximize an efficacy of the plasma display panel a frequency of the sustain pulse supplied for sustaining the discharge cell in the driving circuit is greater than 500KHz and less than or equal to 1MHz due to electromagnetic interference.

32. The plasma display panel of claim 31, wherein the frequency has a range from 700KHz to 1MHz.

* * * * *